US011649828B2

(12) United States Patent
Miyata et al.

(10) Patent No.: US 11,649,828 B2
(45) Date of Patent: May 16, 2023

(54) ROTARY MACHINE

(71) Applicant: MITSUBISHI HEAVY INDUSTRIES COMPRESSOR CORPORATION, Tokyo (JP)

(72) Inventors: Hiroyuki Miyata, Hiroshima (JP); Hideki Nagao, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 0 days.

(21) Appl. No.: 17/651,959

(22) Filed: Feb. 22, 2022

(65) Prior Publication Data

US 2022/0268291 A1 Aug. 25, 2022

(30) Foreign Application Priority Data

Feb. 25, 2021 (JP) ..... JP2021-028524

(51) Int. Cl.

| | |
|---|---|
| ***F04D 29/20*** | (2006.01) |
| ***F04D 29/044*** | (2006.01) |
| ***F04D 29/043*** | (2006.01) |
| ***F04D 29/053*** | (2006.01) |
| ***F04D 29/054*** | (2006.01) |
| ***F04D 29/58*** | (2006.01) |
| *F04D 29/28* | (2006.01) |

(Continued)

(52) U.S. Cl.

CPC ..... *F04D 29/20* (2013.01); *F04D 29/043* (2013.01); *F04D 29/044* (2013.01); *F04D 29/053* (2013.01); *F04D 29/054* (2013.01); *F04D 29/584* (2013.01); *F04D 29/5846* (2013.01); *F04D 25/028* (2013.01); *F04D 25/163* (2013.01); *F04D 29/266* (2013.01); *F04D 29/284* (2013.01)

(58) Field of Classification Search

CPC .... F04D 25/028; F04D 25/163; F04D 29/043; F04D 29/044; F04D 29/053; F04D 29/054; F04D 29/20; F04D 29/266; F04D 29/284; F04D 29/584; F04D 29/5846; F01D 5/025

See application file for complete search history.

(56) References Cited

U.S. PATENT DOCUMENTS 2,577,134 A * 12/1951 Land ..... F02B 33/00 416/171
4,340,317 A * 7/1982 Heitmann ..... F16D 1/06 417/407

(Continued)

FOREIGN PATENT DOCUMENTS

| | | |
|---|---|---|
| EP | 1193370 A2 | 4/2002 |
| GB | 1249863 A | 10/1971 |

*Primary Examiner* — Courtney D Heinle
*Assistant Examiner* — Andrew J Marien
(74) *Attorney, Agent, or Firm* — Osha Bergman Watanabe & Burton LLP

(57) ABSTRACT

A rotary machine includes a cylindrical rotary shaft extending in a direction of an axis, a fastening bolt having a bolt body that extends in a direction of an axis O in the rotary shaft to form fastening portions at both ends, a pair of rotary bodies each having an end portion in the direction of the axis that is fixed to each of the pair of fastening portions to be in contact with an end surface of the rotary shaft in the direction of the axis, and a bolt extension mechanism that temporarily extends the bolt body in the direction of the axis.

5 Claims, 3 Drawing Sheets

(51) Int. Cl.

| | |
|---|---|
| *F04D 25/02* | (2006.01) |
| *F04D 25/16* | (2006.01) |
| *F04D 29/26* | (2006.01) |

(56) References Cited

U.S. PATENT DOCUMENTS

| | | | | |
|---|---|---|---|---|
| 6,364,634 | B1 * | 4/2002 | Svihla | F04D 29/266 417/409 |
| 6,481,917 | B1 * | 11/2002 | Chen | F16D 1/076 415/99 |
| 6,499,969 | B1 * | 12/2002 | Tombers | F01D 5/066 417/407 |
| 9,500,201 | B2 | 11/2016 | Hutten et al. | |
| 2010/0054944 | A1 * | 3/2010 | Fledersbacher | F01D 5/025 416/204 A |
| 2013/0101433 | A1 * | 4/2013 | Colson | F04D 29/266 29/889 |
| 2016/0319832 | A1 | 11/2016 | Takahara et al. | |
| 2017/0198721 | A1 * | 7/2017 | Cooper | F04D 29/043 |

* cited by examiner

ROTARY MACHINE

BACKGROUND OF THE INVENTION

Field of the Invention

The present disclosure relates to a rotary machine.

Priority is claimed on Japanese Patent Application No. 2021-028524, filed Feb. 25, 2021, the content of which is incorporated herein by reference.

Description of Related Art

For example, Patent Document 1 discloses a rotary machine in which an impeller as a rotary body is fixed to an end portion of a rotary shaft. The impeller is provided with a through hole that passes therethrough in a direction of an axis.

The impeller and the rotary shaft are integrally fixed to each other by fastening a bolt inserted into the through hole to the end portion of the rotary shaft.

SUMMARY OF THE INVENTION

By the way, when an impeller as the rotary body is rotated at high speed, the centrifugal load applied to the impeller also increases. In the rotary machine disclosed in the Patent Document 1, since a through hole passing through the impeller in a direction of an axis is formed, a strength of the impeller is reduced by the through hole.

On the other hand, the rotary body such as the impeller needs to be firmly fixed to the rotary shaft.

The present disclosure provides a rotary machine capable of improving a strength of the rotary body against the centrifugal load while firmly fixing the rotary body to the rotary shaft.

A rotary machine according to the present disclosure includes a rotary shaft that has a cylindrical shape extending in a direction of an axis and has end surfaces at both sides in the direction of the axis, a fastening bolt that extends in the direction of the axis in the rotary shaft and has a bolt body having fastening portions formed at both ends, a pair of rotary bodies each having a fastened portion disposed at both sides of the fastening bolt in the direction of the axis and to be fixed to the fastening portion at an end portion in the direction of the axis, and a contact surface in contact with one of the end surfaces of the rotary shaft, and a bolt extension mechanism that is configured to temporarily extend the bolt body in the direction of the axis.

According to the present disclosure, a strength of the rotary body against a centrifugal load can be improved while firmly fixing the rotary body to the rotary shaft.

DETAILED DESCRIPTION OF THE INVENTION

First Embodiment

Hereinafter, a rotary machine according to an embodiment of the present invention will be described in detail with reference to FIGS. 1 and 2.

<Outline Configuration of Geared Compressor>

Figure 1:
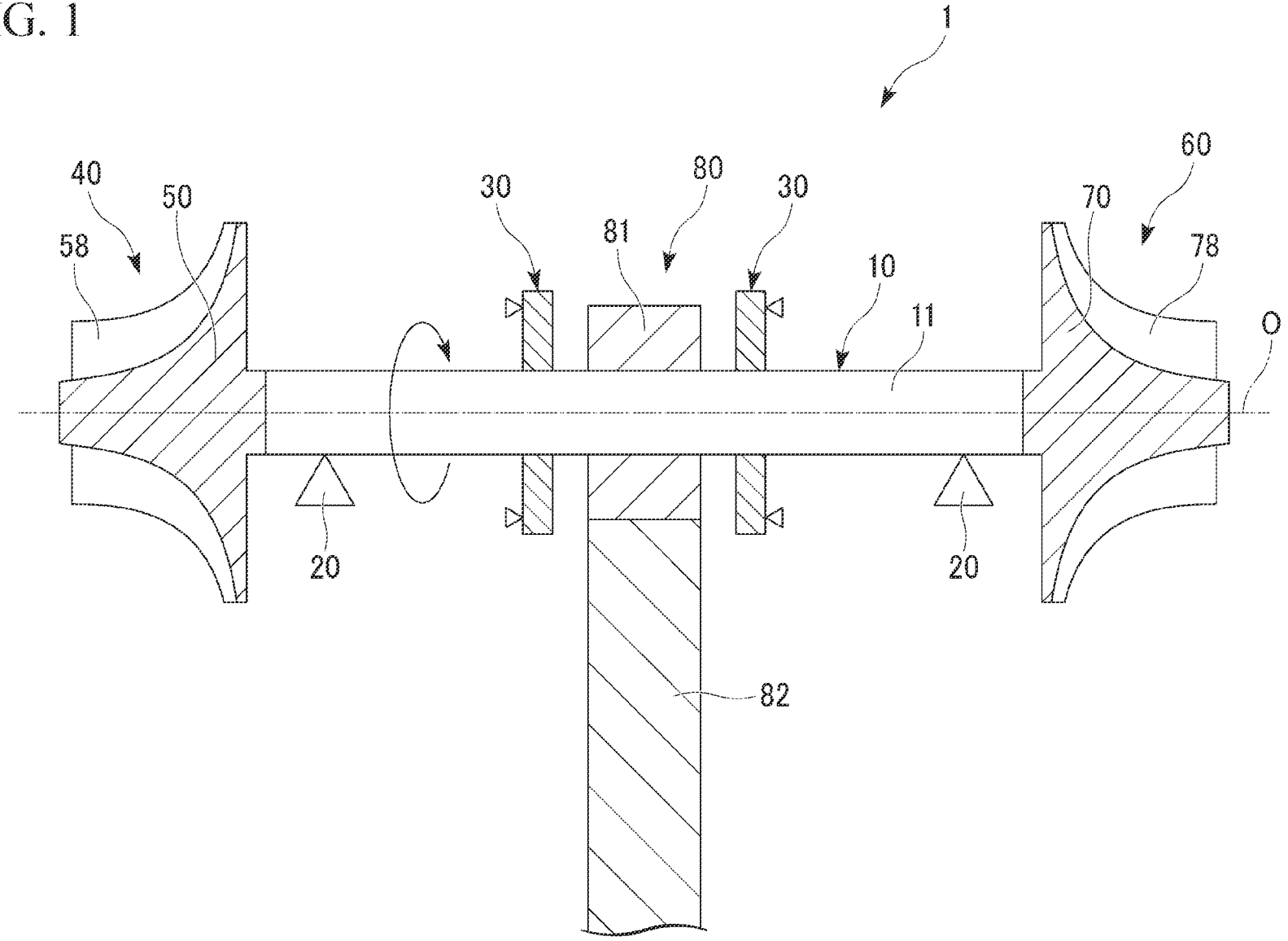
FIG. 1 is a schematic side view of a rotary machine according to a first embodiment of the present disclosure.
Figure 2:
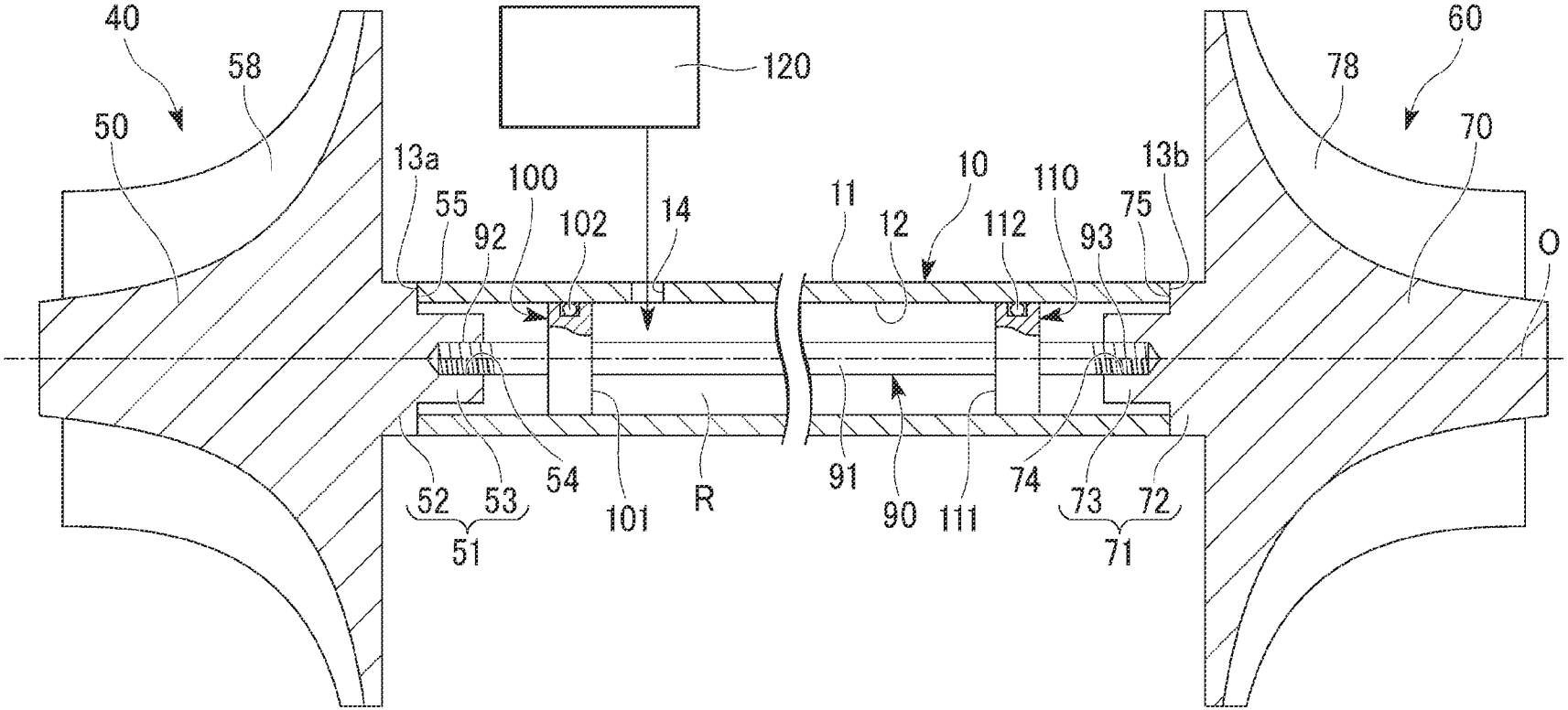
FIG. 2 is a vertical cross-sectional view of a main part of the rotary machine according to the first embodiment of the present disclosure.

As shown in FIG. 1, a geared compressor 1 as a rotary machine has a rotary shaft 10, radial bearings 20, thrust bearings 30, a first impeller 40, a second impeller 60, and a power transmission portion 80.

The rotary shaft 10 extends about an axis O extending in a horizontal direction.

The radial bearings 20 rotatably support the rotary shaft 10 around the axis O. A pair of radial bearings 20 are provided so as to be separated from each other in a direction of the axis O (axial direction). Each of the pair of radial bearings 20 supports the rotary shaft 10 at a position close to an end portion of the rotary shaft 10 in the direction of the axis O.

The thrust bearings 30 support a load applied in the direction of the axis O of the rotary shaft 10. A pair of thrust bearings 30 are provided between the pair of radial bearings 20 so as to be separated from each other in the direction of the axis O.

The first impeller 40 is integrally fixed to the rotary shaft 10 at the first side of the rotary shaft 10 in the direction of the axis O (a left side in FIG. 1). The first impeller 40 has a first disk 50 and first blades 58.

The first disk 50 has a disk shape centered on the axis O. A surface of the first disk 50 facing a first side in the direction of the axis O is curved so as to extend outward in a radial direction toward a second side in the direction of the axis O (a right side in FIG. 1).

A plurality of the first blades 58 are provided on the surface of the first disk 50 facing the first side in the direction of the axis O at intervals in a circumferential direction.

The second impeller 60 is integrally fixed to the rotary shaft 10 at the second side of the rotary shaft 10 in the direction of the axis O. The second impeller 60 has a second disk 70 and second blades 78.

The second disk 70 has a disk shape centered on the axis O. A surface of the second disk 70 facing the second side in the direction of the axis O is curved so as to extend outward in the radial direction toward the first side in the direction of the axis O.

A plurality of the second blades 78 are provided on the surface of the second disk 70 facing the second side in the direction of the axis O at intervals in the circumferential direction.

The power transmission portion 80 transmits a driving force applied from the outside to the rotary shaft 10 to rotate the rotary shaft 10. The power transmission portion 80 has a pinion gear 81 and a large diameter gear 82.

The pinion gear 81 is integrally fixed to the rotary shaft 10 between the pair of thrust bearings 30 on the rotary shaft 10. Gear teeth are formed on an outer peripheral surface of the pinion gear 81.

The large diameter gear 82 is a gear that is rotated by a driving force applied from the outside. Gear teeth on an outer peripheral surface of the large diameter gear 82 are engaged with the gear teeth of the pinion gear 81. When the large diameter gear 82 is driven by a drive unit (not shown), the pinion gear 81 and the rotary shaft 10 integrally fixed to the pinion gear 81 rotate in connection therewith. Accordingly, the first impeller 40 and the second impeller 60 integrated with the rotary shaft 10 also rotate, and gas flowing into the first impeller 40 and the second impeller 60 from the direction of the axis O is pumped outward in the radial direction.

<Fixing Structure to Rotary Shaft and Rotary Body>

Hereinafter, the details of a fixing structure to the rotary shaft 10 and the first impeller 40 and the second impeller 60 will be described with reference to FIG. 2. In addition to the rotary shaft 10, the first impeller 40, and the second impeller 60 as a configuration related to the fixing structure, the geared compressor 1 further includes a fastening bolt 90 and a fluid pressure supply unit 120 as an example of a bolt extension mechanism.

<Rotary Shaft>

The rotary shaft 10 has a cylindrical shape centered on the axis O. That is, the rotary shaft 10 has a hollow structure having a through hole extending over both ends in the direction of the axis O to be open at both ends. The radial dimensions of an outer peripheral surface 11 and an inner peripheral surface 12 of the rotary shaft 10 are uniform. The rotary shaft 10 has a first end surface 13*a* and a second end surface 13*b* as a pair of end surfaces. The first end surface 13*a* is an end surface at the first side of the rotary shaft 10 in the direction of the axis O, and has a planar shape orthogonal to the axis O. The second end surface 13*b* is an end surface at the second side of the rotary shaft 10 in the direction of the axis O, and has a planar shape orthogonal to the axis O like the first end surface 13*a*.

<Fastening Bolt 90>

The fastening bolt 90 is provided inside the rotary shaft 10 that has a cylindrical shape. The fastening bolt 90 has a bolt body 91, a first brim portion 100 and a second brim portion 110 as a pair of brim portions, and a first seal portion 102 and a second seal portion 112 as a pair of seal portions.

<Bolt Body 91>

The bolt body 91 has a rod shape extending in the direction of the axis O with the axis O as the center in the rotary shaft 10. A diameter of the bolt body 91 is smaller than an inner diameter of the rotary shaft 10. Accordingly, an outer peripheral surface of the bolt body 91 and the inner peripheral surface 12 of the rotary shaft 10 are separated from each other.

A first fastening portion 92 and a second fastening portion 93 as a pair of fastening portions are provided at end portions of the bolt body 91 in the direction of the axis O.

The first fastening portion 92 is provided at one end portion of the bolt body 91 at the first side in the direction of the axis O. The first fastening portion 92 has a male screw formed on the outer peripheral surface of the bolt body 91. The second fastening portion 93 is provided at an end portion of the bolt body 91 at the second side in the direction of the axis O. Similar to the first fastening portion, the second fastening portion 93 has a male screw formed on the outer peripheral surface of the bolt body 91. In the present embodiment, the first fastening portion 92 and the second fastening portion 93 are positioned in the rotary shaft 10. The first fastening portion 92 may protrude from the rotary shaft 10 to the first side in the direction of the axis O. The second fastening portion 93 may protrude from the rotary shaft 10 to the second side in the direction of the axis O.

<Brim Portion>

The first brim portion 100 and the second brim portion 110 have a disk shape formed so as to protrude outward in the radial direction from the outer peripheral surface of the bolt body 91. The first brim portion 100 and the second brim portion 110 are provided between the first fastening portion 92 and the second fastening portion 93 to be separated from each other in the direction of the axis O.

The first brim portion 100 is provided at a portion of the bolt body 91 that is closer to the first side in the direction of the axis O. The second brim portion 110 is provided at a portion of the bolt body 91 that is closer to the second side in the direction of the axis O.

Outer peripheral surfaces of the first brim portion 100 and the second brim portion 110 each have a cylindrical surface shape. Outer diameters of the outer peripheral surfaces of the first brim portion 100 and the second brim portion 110 have the same dimensions as an inner diameter of the inner peripheral surface 12 of the rotary shaft 10, or have slightly smaller dimensions than the inner diameter of the inner peripheral surface 12 of the rotary shaft 10. Accordingly, the outer peripheral surfaces of the first brim portion 100 and the second brim portion 110 are slidable in the direction of the axis O with respect to the inner peripheral surface 12 of the rotary shaft 10.

A surface of the first brim portion 100 facing the second side in the direction of the axis O is a first pressure receiving surface 101 having a planar shape orthogonal to the axis O. A surface of the second brim portion 110 facing the first side in the direction of the axis O is a second pressure receiving surface 111 having a planar shape orthogonal to the axis O. The first pressure receiving surface 101 and the second pressure receiving surface 111 face each other in the direction of the axis O.

<Seal Portion>

The first seal portion 102 is provided on an outer peripheral surface of the first brim portion 100. The second seal portion 112 is provided on an outer peripheral surface of the second brim portion 110. The first seal portion 102 and the second seal portion 112 are seal rings such as an O-ring and a C-ring provided in a circumferential direction. The first seal portion 102 and the second seal portion 112 are slidable in the direction of the axis O with respect to the inner peripheral surface 12 of the rotary shaft 10.

The first seal portion 102 and the second seal portion 112 seal a clearance between the outer peripheral surfaces of the first brim portion 100 and the second brim portion 110 and the inner peripheral surface 12 of the rotary shaft 10 in a liquid-tight manner over an entire circumferential direction. Accordingly, an internal space R that is liquid-tightly separated from the other space in the rotary shaft 10 is formed as a partition between the first brim portion 100 and the second brim portion 110 in the rotary shaft 10.

Here, a fluid pressure supply hole 14 passing through an inside and an outside of the rotary shaft 10 is provided at a position in the direction of the axis O corresponding to the internal space R in the rotary shaft 10. The internal space R communicates with the outside of the rotary shaft 10 via the fluid pressure supply hole 14.

<First Impeller>

A first convex portion 51 protruding to the second side in the direction of the axis O with the axis O as the center is provided on a surface of the first disk 50 of the first impeller 40 facing the second side in the direction of the axis O. The first convex portion 51 has a first large diameter portion 52, which is a base end portion at the first side in the direction of the axis O, and a first small diameter portion 53 having a diameter smaller than that of the first large diameter portion 52, which is a tip portion at the second side in the direction of the axis O. The first large diameter portion 52 and the first small diameter portion 53 are each formed in a cylindrical shape having a different diameter from each other while being centered on the axis O.

A first fastened portion 54 is provided on a tip surface of the first small diameter portion 53, which is an end portion of the first impeller 40 at the second side in the direction of the axis O. The first fastened portion 54 is a bolt fixing hole that is recessed at the first side in the direction of the axis O with the axis O as the center. A female screw to be fastened to the male screw of the first fastening portion 92 of the bolt body 91 is formed on an inner peripheral surface of the first fastened portion 54.

The first fastened portion 54 does not pass through the first impeller 40 in the direction of the axis O. Therefore, the first impeller 40 has a solid structure filled inside.

A position of a bottom portion of the first fastened portion 54 in the direction of the axis O has a formation range of the first small diameter portion 53. The position of the bottom portion of the first fastened portion 54 in the direction of the axis O may also have a formation range of the first large diameter portion 52, that is, a formation range of the first convex portion 51. Furthermore, the position of the bottom portion of the first fastened portion 54 in the direction of the axis O may be, for example, a position at the second side of the first disk 50 in the direction of the axis O with respect to the outermost diameter portion.

A stepped surface between the first large diameter portion 52 and the first small diameter portion 53 in the first convex portion 51 is a first contact surface 55 having a planar shape that faces the second side in the direction of the axis O and is orthogonal to the axis O. The first contact surface 55 faces the first end surface 13*a* of the rotary shaft 10 in the direction of the axis O. In a state where the first impeller 40 and the rotary shaft 10 are fixed to and integrated with each other, the first contact surface 55 of the first impeller 40 and the first end surface 13*a* of the rotary shaft 10 are firmly in close contact with each other.

<Second Impeller 60>

A second convex portion 71 protruding from the axis O to the first side in the direction of the axis O with the axis O as the center is provided on a surface of the second disk 70 of the second impeller 60 facing the first side in the direction of the axis O. The second convex portion 71 has a second large diameter portion 72, which is a base end portion at the second side in the direction of the axis O, and a second small diameter portion 73 having a diameter smaller than that of the second large diameter portion 72, which is a tip portion at the first side in the direction of the axis O. The second large diameter portion 72 and the second small diameter portion 73 are each formed in a cylindrical shape having a different diameter from each other while being centered on the axis O.

A second fastened portion 74 is provided on a tip surface of the second small diameter portion 73, which is an end portion of the second impeller 60 at the first side in the direction of the axis O. The second fastened portion 74 is a bolt fixing hole that is recessed at the second side in the direction of the axis O with the axis O as the center. A female screw to be fastened to the male screw of the second fastening portion 93 of the bolt body 91 is formed on an inner peripheral surface of the second fastened portion 74.

The second fastened portion 74 does not pass through the second impeller 60 in the direction of the axis O. Therefore, the second impeller 60 has a solid structure filled inside.

A position of a bottom portion of the second fastened portion 74 in the direction of the axis O has a formation range of the second small diameter portion 73. The position of the bottom portion of the second fastened portion 74 in the direction of the axis O may also have a formation range of the second large diameter portion 72, that is, a formation range of the second convex portion 71. Furthermore, the position of the bottom portion of the second fastened portion 74 in the direction of the axis O may be, for example, a position at the first side of the second disk 70 in the direction of the axis O with respect to the outermost diameter portion.

A stepped surface between the second large diameter portion 72 and the second small diameter portion 73 in the second convex portion 71 is a second contact surface 75 having a planar shape that faces the first side in the direction of the axis O and is orthogonal to the axis O. The second contact surface 75 faces the second end surface 13*b* of the rotary shaft 10 in the direction of the axis O. In a state where the second impeller 60 and the rotary shaft 10 are fixed to and integrated with each other, the second contact surface 75 of the second impeller 60 and the second end surface 13*b* of the rotary shaft 10 are firmly in close contact with each other.

<Fluid Pressure Supply Unit>

The fluid pressure supply unit 120 can supply fluid pressure to the internal space R in the rotary shaft 10 via the fluid pressure supply hole 14. The fluid pressure supply unit 120 supplies hydraulic oil to the internal space R by, for example, an oil pressure pump. Accordingly, when the internal space R is filled with the hydraulic oil, oil pressure (fluid pressure) by the hydraulic oil acts on the first pressure receiving surface 101 of the first brim portion 100 and the second pressure receiving surface 111 of the second brim portion 110. When the supply of the hydraulic oil by the fluid pressure supply unit 120 is stopped, the oil pressure acting on the first pressure receiving surface 101 and the second pressure receiving surface 111 disappears. That is, the fluid pressure supply unit 120 is configured to switch between the supply and stoppage of the oil pressure to the internal space R.

Furthermore, the fluid pressure supply unit 120 may also be configured to supply other liquids, gases, or the like instead of being configured to supply the oil pressure.

<Operational Effects>

Next, in the geared compressor 1 having the above configuration, a procedure for fixedly integrating the rotary shaft 10 into the first impeller 40 and the second impeller 60 will be described.

First, in a state where the fastening bolt 90 to which the first impeller 40 and the second impeller 60 are not fixed is disposed in the rotary shaft 10, hydraulic oil is supplied to the internal space R via the fluid pressure supply hole 14 by the fluid pressure supply unit 120. Accordingly, oil pressure by the hydraulic oil acts on the first pressure receiving surface 101 of the first brim portion 100 and the second pressure receiving surface 111 of the second brim portion 110 in the fastening bolt 90. That is, an external force is applied to the first pressure receiving surface 101 toward the first side in the direction of the axis O, and an external force is applied to the second pressure receiving surface 111 toward the second side in the direction of the axis O. Accordingly, external forces that tend to separate from each other in the direction of the axis O are applied to the first brim portion 100 and the second brim portion 110.

Then, the bolt body 91 integrated with the first brim portion 100 and the second brim portion 110 is pulled to the first side and the second side in the direction of the axis O in association with a separation movement between the first brim portion 100 and the second brim portion 110. Accordingly, the bolt body 91 is temporarily extended in the direction of the axis O. At this time, the first fastening portion 92 of the bolt body 91 is in a state of being positioned at the first side of the axis O direction compared to the initial position, and the second fastening portion 93 is in a state of being positioned at the second side of the axis O direction compared to the initial position.

In this state, the first impeller 40 and the second impeller 60 are attached and fixed to the fastening bolt 90. That is, the first fastened portion 54 of the first impeller 40 is fastened to the first fastening portion 92 of the bolt body 91. Moreover, the second impeller 60 is fastened to the second fastening portion 93 of the bolt body 91. Accordingly, the first impeller 40 and the second impeller 60 are fixed to and integrated with the fastening bolt 90. In a state where the first impeller 40 and the second impeller 60 are fastened to the bolt body 91 in this manner, the first contact surface 55 of the first impeller 40 and the first end surface 13*a* of the rotary shaft 10 are separated from each other, and the second contact surface 75 of the second impeller 60 and the second end surface 13*b* of the rotary shaft 10 are separated from each other.

Then, when the supply of hydraulic oil by the fluid pressure supply unit 120 is stopped in the above state, an action of the oil pressure on the first pressure receiving surface 101 of the first brim portion 100 and the second pressure receiving surface 111 of the second brim portion 110 is released, and as a result, the bolt body 91 pulled by the first brim portion 100 and the second-brim portion 110 tends to return to the original dimensions. As a result, the extension of the bolt body 91 is released. At the same time, the first contact surface 55 of the first impeller 40 and the first end surface 13*a* of the rotary shaft 10, the second contact surface 75 of the second impeller 60 and the second end surface 13*b* of the rotary shaft 10, which had been separated from each other until then, come into close contact with each other. Accordingly, the rotary shaft 10, and the first impeller 40 and the second impeller 60 are firmly fixed and integrated via surface pressure at contact points with each other. A torque of the rotary shaft 10 is reliably transmitted to the first impeller 40 and the second impeller 60 via a frictional force due to the surface pressure.

According to the present embodiment as described above, the first impeller 40 and the second impeller 60 are fastened to the bolt body 91 in a state where the bolt body 91 is extended in the direction of the axis O by the fluid pressure supply unit 120 as a bolt extension mechanism. Then, when the extension of the bolt body 91 by the fluid pressure supply unit 120 is released later, the bolt body 91 returns to the original dimensions, and the first impeller 40 and the second impeller 60 come into close contact with the rotary shaft 10. Accordingly, the rotary body and the rotary shaft 10 can be firmly fixed to and integrated with each other.

In addition, for the fastening of the first impeller 40 and the second impeller 60 to the bolt body 91, since the bolt body 91 is in an extended state, a fastening work can be performed in a state where each of the first fastening portion 92 and the second fastening portion 93 of the bolt body 91 is easily accessed from the outside. Accordingly, the first impeller 40 and the second impeller 60 can be easily attached to the bolt body 91.

Moreover, since the end portions of the first impeller 40 and the second impeller 60 are fixed to the bolt body 91, it is not necessary to provide through holes or the like that pass through the first impeller 40 and the second impeller 60. Therefore, the strengths of the first impeller 40 and the second impeller 60 can be ensured. Therefore, it is possible to sufficiently withstand a centrifugal stress when the geared compressor 1 operates at high speed.

Further, since the extension of the bolt body 91 is performed by the fluid pressure supply unit 120, it is not necessary to provide a separate device in a narrow internal space R in the rotary shaft 10. Therefore, it is not necessary to perform complicated work when extending the bolt body 91. Consequently, the first impeller 40 and the second impeller 60 can be easily fixed to the rotary shaft 10.

Second Embodiment

Figure 3:
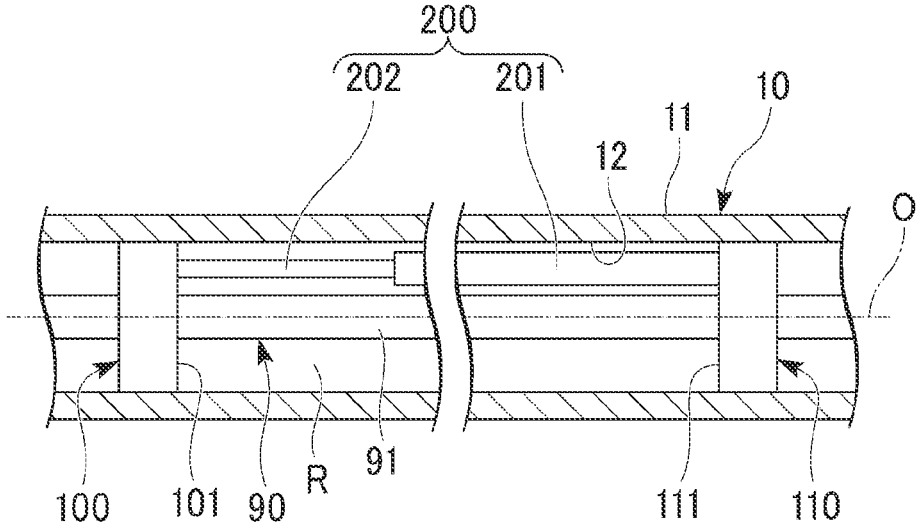
FIG. 3 is a vertical cross-sectional view of a main part of the rotary machine according to a second embodiment of the present disclosure.

Next, a second embodiment of the present invention will be described with reference to FIG. 3. In FIG. 3, the same elements as those in FIG. 2 are designated by the same reference numerals, and detailed description thereof will be omitted.

Whereas the bolt extension mechanism in the first embodiment is the fluid pressure supply unit 120, the present embodiment includes an extensible portion 200 as the bolt extension mechanism.

The extensible portion 200 is provided in the internal space R of the rotary shaft 10. The extensible portion 200 is a cylinder rod mechanism having a tubular cylinder 201 extending in the direction of the axis O and a rod 202 capable of being retractable from the cylinder 201 in the direction of the axis O. In the present embodiment, an end portion of the cylinder 201 at the second side in the direction of the axis O is in contact with the second pressure receiving surface 111, and an end portion of the rod 202 protruding from the cylinder 201 to the first side in the direction of the axis O is in contact with the first pressure receiving surface 101.

The rod 202 is freely retractable in the direction of the axis O by fluid pressure supplied to the cylinder 201 from the outside or an actuator provided in the cylinder 201. Accordingly, when the rod 202 is advanced from the cylinder 201, the dimension of the extensible portion 200 in the direction of the axis O becomes longer, and as a result, the first brim portion 100 and the second brim portion 110 can separated from each other to extend the bolt body 91. Therefore, the same operational effects as those of the first embodiment can be obtained.

Furthermore, a configuration other than the cylinder rod mechanism may be adopted for the extensible portion 200, and for example, a linear motion mechanism including a ball screw or the like may be adopted.

Third Embodiment

Figure 4:
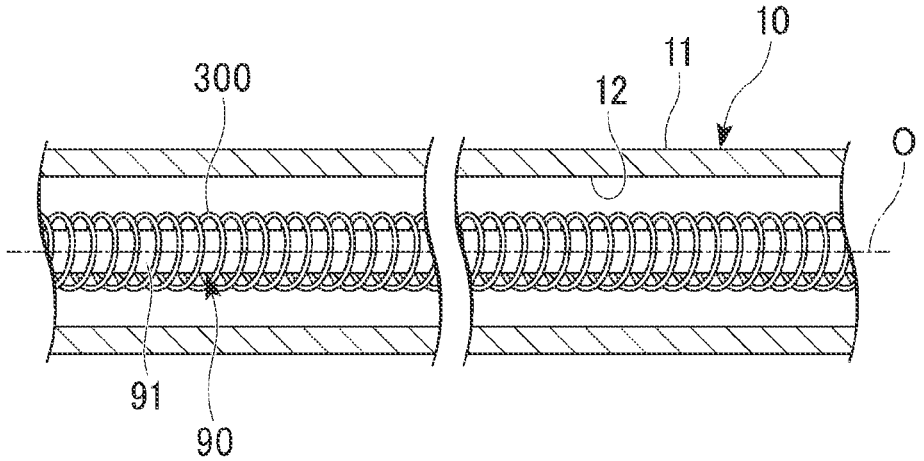
FIG. 4 is a vertical cross-sectional view of a main part of the rotary machine according to the third embodiment of the present disclosure.

Next, a third embodiment of the present invention will be described with reference to FIG. 4. In FIG. 4, the same elements as those in FIG. 2 are designated by the same reference numerals, and detailed description thereof will be omitted.

Whereas the bolt extension mechanism in the first embodiment is the fluid pressure supply unit 120, the present embodiment includes a heating unit 300 as the bolt extension mechanism.

The heating unit 300 has a structure capable of heating the bolt body 91. For the heating unit 300, for example, as shown in FIG. 4, a heating wire wound around the bolt body 91 can be adopted. By energizing the heating wire from the outside, the heating wire generates heat due to Joule heat. Accordingly, when the bolt body 91 around which the heating wire is wound is heated, the bolt body 91 thermally expands to extend in the direction of the axis O. Consequently, the same operational effects as those of the first and second embodiments can be obtained.

Furthermore, in addition to the heating wire, various configurations such as other heat sources and an induction heating device may be adopted for the heating unit 300.

Other Embodiments

While preferred embodiments of the invention have been described and illustrated above, it should be understood that these are exemplary of the invention and are not to be considered as limiting. Additions, omissions, substitutions, and other modifications can be made without departing from the scope of the invention. Accordingly, the invention is not to be considered as being limited by the foregoing description and is only limited by the scope of the appended claims.

For example, in the embodiments, an example in which the first impeller 40 and the second impeller 60 are adopted as rotary bodies has been described, but the present invention is not limited thereto. One of a pair of rotary bodies may be a counterweight. This also produces the same operational effects.

Moreover, in the embodiments, an example in which the bolt body 91 of the fastening bolt 90 is extended, and then both the first impeller 40 and the second impeller 60 are attached thereto has been described, but for example, one rotary body may be attached to the bolt body 91 before the bolt body 91 is extended. In this case, the bolt body 91 is extended in a state where one rotary body is attached to the bolt body 91, and the other rotary body is attached to the bolt body 91. Thus, the other rotary body can be easily attached thereto, and the same operational effects as those of the embodiments can be obtained.

Further, in the embodiments, an example in which the present invention is applied to the geared compressor 1 has been described, but the present invention may also be applied to a compressor having another configuration or another rotary machine.

<Supplement>

A rotary machine disclosed in each embodiment is understood as follows, for example.

(1) According to a first aspect, the rotary machine includes the rotary shaft 10 that has a cylindrical shape extending in a direction of the axis O and has end surfaces at both sides in the direction of the axis O, the fastening bolt 90 that has the bolt body 91 extending in the direction of the axis O in the rotary shaft 10 and having fastening portions formed at both ends, the first impeller 40 and the second impeller 60 each having the first fastened portion 54 disposed at both sides of the fastening bolt 90 in the direction of the axis O and the second fastened portion 74 to be fixed to the first fastening portion 92 and the second fastening portion 93 at an end portion in the direction of the axis O, and a contact surface in contact with one of the end surfaces of the rotary shaft 10, and a bolt extension mechanism that is configured to temporarily extend the bolt body 91 in the direction of the axis O.

According to the above configuration, the first fastened portion 54 of the first impeller 40 and the second fastened portion 74 of the second impeller 60 are attached to the first fastening portion 92 and the second fastening portion 93 of the bolt body 91 in a state where the bolt body 91 is extended in the direction of the axis O by the bolt extension mechanism. Then, when the extension of the bolt body 91 by the bolt extension mechanism is released later, the bolt body 91 returns to the original dimensions, and the first contact surface 55 of the first impeller 40 and the second contact surface 75 of the second impeller 60 come into contact with the end surfaces of the rotary shaft 10. Accordingly, the first impeller 40, the second impeller 60 and the rotary shaft 10 are firmly in close contact with each other, and the first impeller 40, the second impeller 60 and the rotary shaft 10 are integrally fixed to each other.

Further, since the end portions of the first impeller 40 and the second impeller 60 are fixed to the bolt body 91, it is not necessary to provide through holes or the like in the first impeller 40 and the second impeller 60. Therefore, the strengths of the first impeller 40 and the second impeller 60 can be ensured.

(2) According a second aspect, in the rotary machine according to the first aspect, the fastening bolt 90 further has a pair of the first brim portion 100 and the second brim portion 110 disposed to be separated from each other in the direction of the axis O to protrude from an outer peripheral surface of the bolt body 91, and slidably contacting the inner peripheral surface 12 of the rotary shaft 10 in the direction of the axis O, and the bolt extension mechanism is configured to apply an external force to the first brim portion 100 and the second brim portion 110 such that the first brim portion 100 and the second brim portion 110 are separated from each other in the direction of the axis O.

The bolt body 91 integrally fixed to the first brim portion 100 and the second brim portion 110 can be extended in the direction of the axis O by separating those brim portions from each other in the direction of the axis O.

(3) According to a third aspect, in the rotary machine according to the second aspect, the bolt extension mechanism is the fluid pressure supply unit 120 that is configured to supply fluid pressure to a space partitioned by the pair of brim portions in the rotary shaft 10.

Accordingly, the first brim portion 100 and the second brim portion 110 can be easily separated from each other in a narrow space provided with the first brim portion 100 and the second brim portion 110 in the rotary shaft 10.

(4) According to a fourth aspect, in the rotary machine according to the second aspect, the bolt extension mechanism is the extensible portion 200 disposed in the internal space R partitioned by the first brim portion 100 and the second brim portion 110 in the rotary shaft 10 to separate a pair of the first brim portion 100 and the second brim portion 110 by extending in the direction of the axis O.

Accordingly, the first brim portion 100 and the second brim portion 110 can be easily separated from each other.

(5) According to a fifth aspect, in the rotary machine according to the first aspect, the bolt extension mechanism is the heating unit 300 disposed in the rotary shaft 10 to heat the bolt body 91.

The bolt body 91 can be heated and thermally extended by the heating unit 300 to temporarily extend the bolt body 91.

(6) According to a sixth aspect, in the rotary machine according to any one of the first to fifth aspects, the first impeller 40 and the second impeller 60 have a solid structure.

Accordingly, a strength of the rotary body against a centrifugal load can be ensured.

EXPLANATION OF REFERENCES

1 Geared compressor
10 Rotary shaft
11 Outer peripheral surface
12 Inner peripheral surface
13*a* First end surface
13*b* Second end surface
14 Fluid pressure supply hole
20 Radial bearing
30 Thrust bearing
40 First impeller (rotary body)
50 First disk
51 First convex portion

52 First large diameter portion
53 First small diameter portion
54 First fastened portion (fastened portion)
55 First contact surface (contact surface)
58 First blade
60 Second impeller (rotary body)
70 Second disk
71 Second convex portion
72 Second large diameter portion
73 Second small diameter portion
74 Second fastened portion (fastened portion)
75 Second contact surface (contact surface)
78 Second blade
80 Power transmission portion
81 Pinion gear
82 Large diameter gear
90 Fastening bolt
91 Bolt body
92 First fastening portion (fastening portion)
93 Second fastening portion (fastening portion)
100 First brim portion
101 First pressure receiving surface
102 First seal portion
110 Second brim portion
111 Second pressure receiving surface
112 Second seal portion
120 Fluid pressure supply unit (bolt extension mechanism)
200 Extensible portion (bolt extension mechanism)
201 Cylinder
202 Rod
300 Heating unit (bolt extension mechanism)
R Internal space
O Axis

What is claimed is:

1. A rotary machine comprising:

a rotary shaft that has a cylindrical shape extending in a direction of an axis and has end surfaces at both sides in the direction of the axis;

a fastening bolt that has a bolt body extending in the direction of the axis in the rotary shaft and having fastening portions formed at both ends;

a pair of rotary bodies each having a fastened portion disposed at both sides of the fastening bolt in the direction of the axis and to be fixed to each of the fastening portions at an end portion in the direction of the axis, and a contact surface in contact with one of the end surfaces of the rotary shaft; and a bolt extension mechanism that is configured to temporarily extend the bolt body in the direction of the axis, wherein the fastening bolt further has a pair of brim portions disposed to be separated from each other in the direction of the axis to protrude from an outer peripheral surface of the bolt body, and slidably contacting an inner peripheral surface of the rotary shaft in the direction of the axis, and the bolt extension mechanism is configured to apply an external force to the pair of brim portions such that the brim portions are separated from each other in the direction of the axis.

2. The rotary machine according to claim 1, wherein the bolt extension mechanism is a fluid pressure supply unit that is configured to supply fluid pressure to a space partitioned by the pair of brim portions in the rotary shaft.

3. The rotary machine according to claim 1, wherein the bolt extension mechanism is an extensible portion disposed in a space partitioned by the pair of brim portions in the rotary shaft to separate the pair of brim portions by extending in the direction of the axis.

4. The rotary machine according to claim 1, wherein each of the rotary bodies has a solid structure.

5. A rotary machine comprising:

a rotary shaft that has a cylindrical shape extending in a direction of an axis and has end surfaces at both sides in the direction of the axis;

a fastening bolt that has a bolt body extending in the direction of the axis in the rotary shaft and having fastening portions formed at both ends;

a pair of rotary bodies each having a fastened portion disposed at both sides of the fastening bolt in the direction of the axis and to be fixed to each of the fastening portions at an end portion in the direction of the axis, and a contact surface in contact with one of the end surfaces of the rotary shaft; and a bolt extension mechanism that is configured to temporarily extend the bolt body in the direction of the axis, wherein the bolt extension mechanism is a heating unit disposed in the rotary shaft to heat the bolt body.

* * * * *